United States Patent [19]

Hannecke

[11] Patent Number: 4,585,128

[45] Date of Patent: Apr. 29, 1986

[54] ARTICLE DISPLAY STAND

[76] Inventor: Wolf-Dietrich Hannecke, Rischenau Weg 6, 3410 Northeim, Fed. Rep. of Germany

[21] Appl. No.: 521,738

[22] Filed: Aug. 9, 1983

[30] Foreign Application Priority Data

Sep. 8, 1982 [DE] Fed. Rep. of Germany ... 8225277[U]

[51] Int. Cl.[4] ..... A47F 7/00

[52] U.S. Cl. ..... 211/51; 211/50; 312/190; 312/183

[58] Field of Search ..... 211/51, 126, 13, 44, 211/45, 120, 69.8, 50; 312/185, 190, 183, 10; D19/92, 90, 75

[56] References Cited

U.S. PATENT DOCUMENTS

| | | | |
|---|---|---|---|
| 877,671 | 1/1908 | Simmons | 211/51 |
| 2,523,908 | 9/1950 | Johnsen | 211/45 X |
| 2,564,518 | 8/1951 | Bedinger | 211/51 |
| 4,336,759 | 6/1982 | Hannecke | 108/144 |

*Primary Examiner*—Robert W. Gibson, Jr.
*Assistant Examiner*—Blair M. Johnson
*Attorney, Agent, or Firm*—Michael J. Striker

[57] ABSTRACT

An article display stand, particularly for sheet-like data carriers, has a substantially horizontal bottom plate with an outer edge, and at least two pairs of substantially vertical lateral walls arranged on the bottom plate and forming at least two upwardly open elongated compartments for accommodating objects in an upright position and provided with object withdrawing openings in the region of the outer edge of the bottom plate, wherein the lateral walls of each of the compartments approach one another in direction toward the respective withdrawing openings, so that each of the compartments forms an angle in direction of its elongation, and the withdrawing openings of the two compartments are located near one another.

25 Claims, 2 Drawing Figures

ARTICLE DISPLAY STAND

BACKGROUND OF THE INVENTION

The present invention relates to an article display stand for displaying flat objects, particularly record carriers such as postcards, photographs and the like, having a horizontal bottom plate and two upwardly open elongated compartments formed by two pairs of vertical lateral walls arranged on the bottom plate, as well as provided with withdrawing openings in the region of the outer edge of the bottom plate.

Article display stands of the above mentioned general type are known in the art. They are formed as consoles on furniture, standing walls and the like. In particular they are used as so-called etageres for display stands. A plate-shaped goods support of this type, so-called etagere plate, is disclosed for example in the DE-GM 7,706,490 or U.S. Pat. No. 4,336,759. The compartments of this support are distributed on the periphery one after the other in a substantially tangential manner. Thereby the relatively voluminous objects, particularly books, which possess their own standing stability can be supported for presentation of their front surfaces. However, for this purpose simultaneously the partial peripheral surfaces are required. The utilization of these peripheral surfaces is relatively limited. It is often desirable to display flat objects, and particularly sheet-shaped record carriers such as postcards, large cards and synthetic plastic cards as well as photographs, so that the entire image surface required for sale of such objects or record carriers is visible for the observer. It is known for this purpose to use in a so-called front presentation a vending rotary stand of wire or sheet. Also, flat wall hangers for such a front presentation are used. In these vending rotary stands or wall hangers, the record carriers are arranged in the individual receiving or supporting compartments near one another and over one another, so that the rotary stand or the wall hanger must have the same width as the record carriers arranged near one another. The surface utilization of such known arrangements is therefore relatively poor.

SUMMARY OF THE INVENTION

Accordingly, it is an object of the present invention to provide an article display stand which avoids the disadvantages of the prior art.

More particularly, it is an object of the present invention to provide an article display stand in which both in the case of console-like arrangement and the etagere-like arrangement an essentially increased surface utilization is provided, particularly utilization of the width available in horizontal direction. Therefore, the stability of standing of objects, on the one hand, and the withdrawal of the objects, on the other hand, are facilitated.

It is also an object of the present invention as a whole to provide complete presentation of the desired surfaces and at the same time to improve the serviceability of the stand for a maximum number of objects or record carriers.

In keeping with these objects and with others which will become apparent hereinafter, one feature of the present invention resides, briefly stated, in an article display stand which has a bottom plate and two pairs of lateral walls forming at least two compartments, wherein the lateral walls of each compartment approach one another in direction towards the withdrawing openings so that each compartment in its direction of elongation forms an angle, and their withdrawing openings are located near one another.

Both compartments extend, when seen from above, in an approximately V-like form. This means that the width of the arrangement required for the complete displaying of the image surfaces of these objects or record carriers is substantially reduced. This advantage occurs in particular with the arrangement of a plurality of such V-shaped compartment pairs near one another, or on the periphery of a so-called etagere. It has been shown that in comparison with the above described flat-front presentation, the width consumption for the same number of the displayed objects or record carriers with complete visibility of the image surfaces can be reduced to approximately one-fifth. The objects or record carriers are arranged in approximately V-like form relative to the observer, and their withdrawal is improved, since during observation the objects can be easily engaged and easily pulled out from the respective compartments. This is true both for the flat-like arrangement of the compartments on a presentation wall, and also with their formation as an etagere for a vending rotary stand, etc.

In accordance with one feature of the present invention, inner lateral walls which face toward one another have longitudinal portions facing toward the withdrawing openings and united so as to form a common one-piece wall portion. It is therefore possible to guide the objects forwardly in a tight manner, whereas rearwardly they are spaced from one another in the above-mentioned V-like form. This leads to a further increase of the surface utilization, as well as to an especially favorable observation and withdrawal of the presented objects or record carriers. Simultaneously, an especially advantageously simple structural form is obtained. It is advantageous to form the one-piece wall portion wedge-shaped with an apex directed toward the withdrawing openings. The wedge-shaped wall portion can provide advantageous design for the presentation of the objects, on the one hand, and for the withdrawal of the objects, on the other hand.

In accordance with still another feature of the present invention, at least the outer lateral walls and thereby the course of the compartments are curved from the withdrawing openings outwardly in an arcuate manner. In addition to the thus provided visibility of the image surfaces of the objects or record carriers and their stability, an open funnel-shaped free space is formed between the respective outer lateral wall and the record carrier. This funnel-shaped free space essentially facilitates repeated introduction of the objects or record carriers into the compartment, which is especially important in the event of easily bendable record carriers such as postcards, photographs, and the like.

In accordance with a further feature of the present invention, at least one flat spring element is held on the inner lateral walls of each compartment so as to act upon the inserted object, free passing ends of the flat spring element abut against the rear portion of the respective outer wall and thereby at the rear end of each compartment and each lateral outer wall a frictional engagement of the objects and particularly sheet-shaped record carrier is provided, which is needed also for withdrawal of individual record carriers from an inserted stack. At the same time, in cooperation with the arcuate lateral walls and compartments, the wedge-shaped wall portion, and the spring element, the formation of the funnel-shaped free space is provided, so that insertion, withdrawal and repeated insertion, particular of the sheet-like record carriers, are considerably simplified and at the same time the reliable holding of the objects and record carriers in the compartment is improved.

For the reliable functioning, on the one hand, and a simple manufacture and mounting, on the other hand, it is advantageous when in accordance with still a further feature of the present invention the flat spring element of each compartment is formed as a substantially V-shaped one-piece spring part which is held with its apex at the rear end of the wedge-shaped wall portion, so that its legs are deflectable independently of one another. Thereby the objects accommodated in the compartment, and particularly sheet-shaped record carriers, are arranged under the action of a sufficient pressure by the spring leg independently of the filling condition. It is advantageous when the longitudinal edges of at least one leg of the spring part are somewhat angled or curved, so as to prevent damage to the record carriers. Furthermore, it is advantageous when at least the pressing ends of the leg of the spring part or the flat spring element are coated or lined with material having a high adhesive friction coefficient.

Reliable functioning and first of all simple construction and mounting are attained when the apex of the spring part is self-clampingly held with a mouth-shaped formation on a pin which is formed at the rear end of the wedge-shaped wall portion. The entire spring part can be easily manufactured and then mounted by a simple fitting onto the pin.

A further feature of the invention is that the legs and the pressing ends of the spring part are arcuately curved so that the completely filled compartment only the pressing end abuts against the inserted objects with application of pressure. It is thereby obtained that a reliable but not disadvantageous resistance against the withdrawal is provided by the action upon the objects or record carriers. At the same time the above described funnel-shaped free space for insertion and repeated insertions is maintained.

Each lateral wall can be formed, in accordance with another feature of the present invention, as a low guiding web arranged on the bottom plate and raised in a rear end portion for forming an abutment surface for the clamping end of the spring part. Thereby for the material economy in condition of completely reliable functioning, the expansion of the lateral walls is limited to a minimum, and the free visibility of the surfaces of the record carriers to be observed is improved. Simultaneously a reliable holding of the record carrier in the compartment is provided by the spring element or the spring part. When the front ends of the outer lateral walls or guiding webs which form the withdrawal openings are outwardly curved in a funnel-like manner, the introduction or repeated introduction of the objects or record carriers is essentially promoted or facilitated. In particular, a maximum damage-free movement into the compartment is provided also in the event of robust treatment in public.

Withdrawal, insertion and reliable stability of the objects and record carriers can be improved when, in accordance with the present invention, the bottom plate in the region of the withdrawing openings is rounded beyond the apex of the wedge-shaped wall portion. It is advantageous that the front end (apex) of the wedge-shaped wall portion is offset rearwardly from the front end of the outer lateral walls or guiding webs. It is provided in this case that the objects inserted in the compartment and particularly the sheet-like record carriers are brought together in front of the apex of the wedge-shaped wall portion, the forwardly extending edges of the record carriers contact one another, so that the presentation and the withdrawability is promoted, particularly with offset or rugged arrangement of the objects or record carriers in the compartment.

The above described conditions of insertion or repeated insertion of the objects or record carriers by the outwardly curved ends of the outer lateral walls or guiding webs can further be improved when the upper edges of the lateral walls or guiding webs are rounded and inclined toward the compartment. In this case, a forced guidance of the inserted objects or sheet-shaped record carriers towards the compartment is provided.

For reliable adjustment and holding, at least one end abutment limits the depth of the compartment and is arranged displaceable and/or adjustable. This end abutment can be arranged insertable or pivotable on the bottom plate, and can be formed in the upper region of the respective lateral wall as pivotable abutment. It is advantageous when this end abutment is inclined toward the direction of elongation of the compartment, so that when a plurality of sheet-shaped objects or record carriers is inserted into the compartment they are offset from one another in stepped manner in the direction of elongation of the compartment. In this case with insertion against the end abutment, the objects or the record carriers forcibly assume an offset or scale-like arrangement which substantially improves the removal of individual objects and record carriers.

When the article display stand is provided with several pairs of angle-enclosing compartments, the compartment pairs can be arranged, in accordance with a further feature of the present invention, in a star-like manner on a common bottom plate with the withdrawal openings directed toward the periphery. Therefore a support or a so-called etagere for a vending stand and especially vending rotary stand is provided which guarantees at its periphery complete visibility of the image surface of the objects or record carriers with an extraordinarily increased observation surface. As compared with the flat or peripherally distributed known front presentation, the standing and observation surfaces are increased approximately five times.

It is advantageous when the entire bottom place has an outer star-like contour which corresponds to the outer contour of the star-like arranged comparments. The bottom plate has V-shaped cut-outs between the compartment pairs, which leads to a high material economy in the region of the bottom plate and, on the other hand, essentially facilitates the handling of the stand and particularly the etagere in the event of a vending rotary stand.

In accordance with an additional feature of the present invention one of the compartments of each compartment pair is longer than the other compartment of the same compartment pair by extension of the respective lateral walls. It is therefore possible, at least in one compartment, to accommodate longer objects or sheet-like record carriers, for example large cards. Thereby, particularly in an etagere a high space utilization in "dead" surface region of the bottom plate is provided.

In accordance with another feature it is very advantageous when a supply compartment is provided in the region of the bottom plate following the rear ends of the main compartment, with the aid of partitions arranged in this region. Also here the "dead" surface region of the bottom plate or etagere is used as a supply space. Further objects can be withdrawn from this supply compartment for filling of the main compartments at the respective location.

It is advantageous when the bottom plate, the lateral walls or guiding webs, the wedge-shaped wall portion with its pin, and the partitions are composed of a transparent synthetic plastic material. They can be produced as a one-piece element by suitable processes, for example injection molding or vacuum extrusion. In addition to the above described construction, the visibility of the objects at their image surfaces is considerably improved.

The article display stand in accordance with the present invention with one compartment pair or a plurality of compartment pairs can be formed with a flat rear surface so as to be arranged individually or all of them on suitable guides or walls. The inventive stand has a plurality of compartment pairs can be used with great advantage for forming so-called etageres held by a central holding device on a central column, as disclosed for example in U.S. Pat. No. 4,336,759.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENTS

Figure 1:
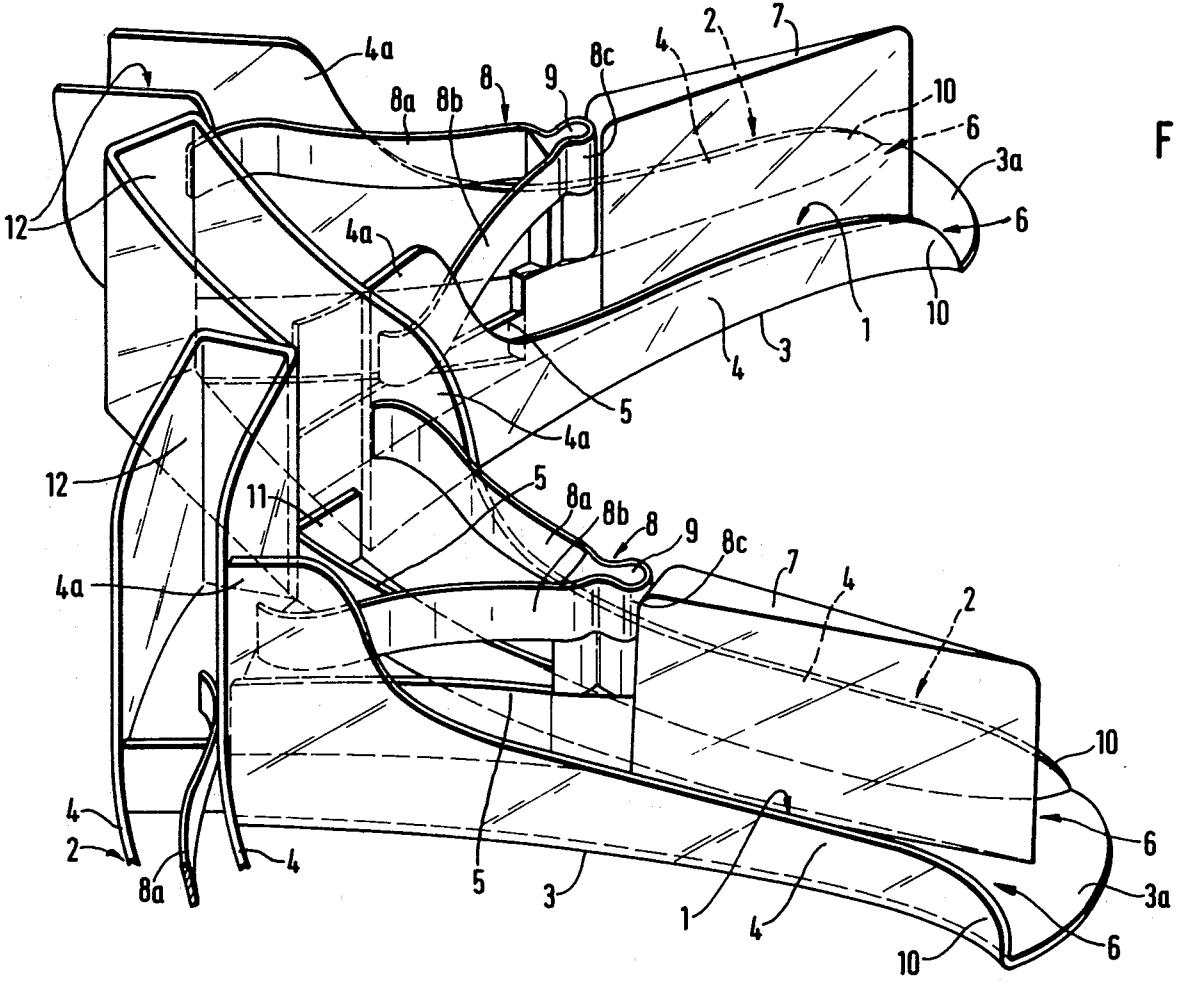
FIG. 1 is a view showing a section of an article display stand in accordance with one embodiment of the present invention.

FIG. 1 shows a peripheral portion of an article display stand in accordance with the present invention, formed as a so-called etagere. It is provided with two pairs of compartments, namely each pair include one compartment 1 and another compartment 2. The compartments 1 and 2 include a bottom plate 3, and an outer lateral wall 4 and an inner lateral wall 5, respectively. The compartments 1 and 2 end respectively in the region of the outer edge of the bottom plate 3, namely at its periphery, in a removing opening 6.

Figure 2:
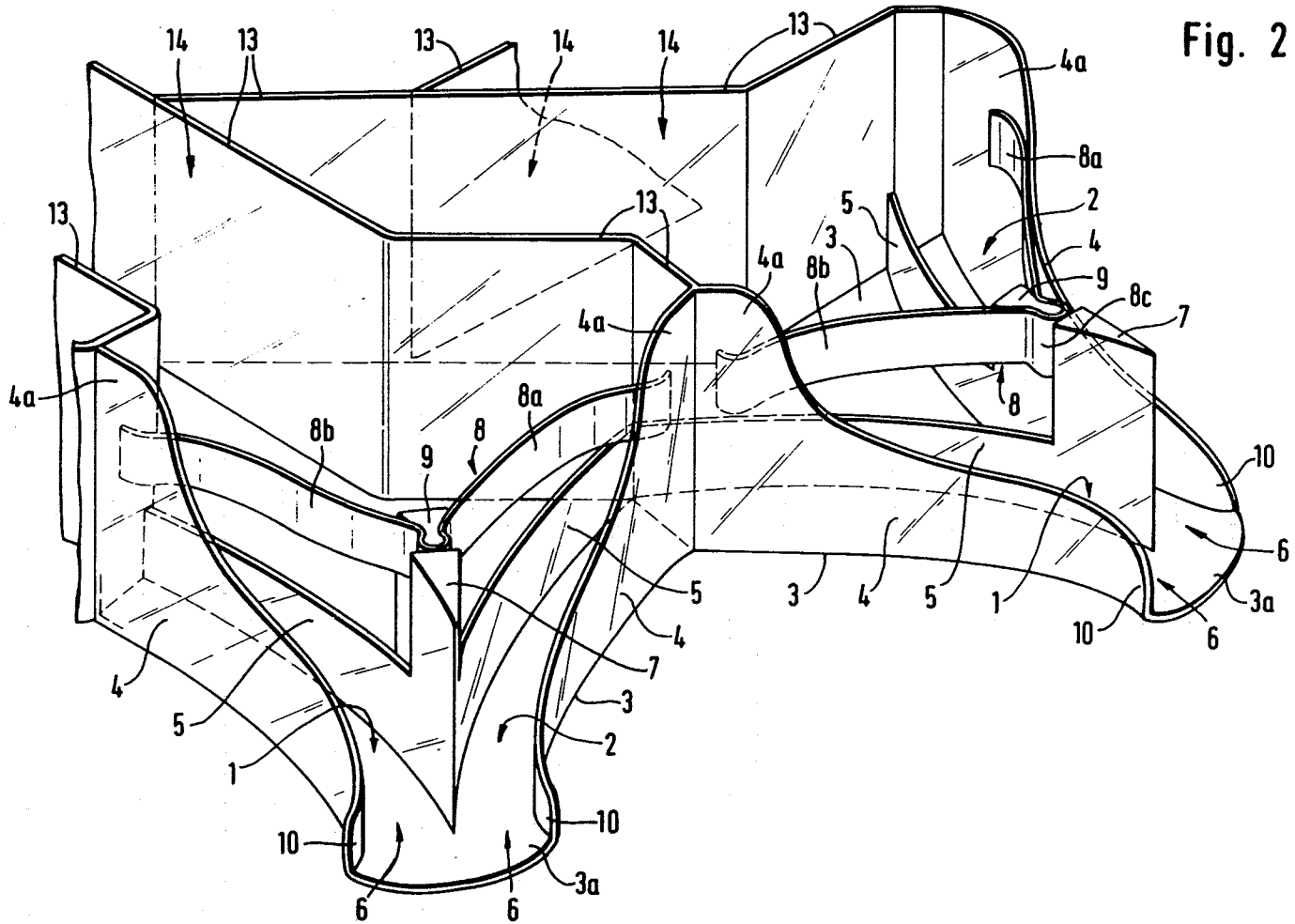
FIG. 2 is a view substantially corresponding to the view of FIG. 1 but showing the article display stand in accordance with another embodiment of the present invention.

As can be seen from the drawings, the lateral walls 4 and 5 of the respective compartments 1 and 2 arranged in one another extend in direction towards the removing openings 6 so that they approach one another, and therefore the compartments 1 and 2 of each pair enclose in direction of their elongation an angle and their removing openings 6 are located near one another. The compartments 1 and 2 thereby form respectively a V with the apex of this angle directed toward the removing openings. The lateral walls 4 and 5 and therefore the course of the compartments 1 and 2 are arcuately curved starting from the receiving openings 6 rearwardly and outwardly, as shown in FIGS. 1 and 2 for both embodiments of the present invention.

The inner walls 5 facing away from one another in each compartment 1 and 2 are united in their longitudinal section facing toward the withdrawing opening 6 so as to form a common one-piece wedge-shaped wall portion 7. At least one flat spring element is held on the inner lateral walls in each compartment so as to act upon the displayed objects. The flat spring elements of both compartments 1 and 2 are formed as a substantially V-shaped common spring part 8 which is held at its apex at the rear end of the wedge-shaped wall portion 7 so that its legs **8*a* and 8*b* are deflectable independently of one another. For this purpose, the apex of the spring part 8 is held in a self-clamping manner on a pin 9 formed at the rear end of the wedge-shaped wall portion 7 with a mouth-shaped formation 8*c***.

The free pressing ends of the legs 8and **8*b* are directed against the rear portion of the associated outer lateral wall 4, as can be seen from the drawing. The legs 8*a* and 8*b* are arcuately curved with their respective pressing end so that with a completely filled compartment 1 or 2 only the pressing end pressingly abuts against the inserted objects. It is advantageous when the longitudinal edges of the legs 8*a* and 8*b* of the spring parts are somewhat angled or curved to prevent damage to the inserted objects. The pressing end is formed advantageously by an inwardly directed bend. At least the pressing ends of the legs 8*a* and 8*b*, in practice however the entire spring part 8**, are advantageously lined or coated with a material which has a high friction coefficient.

As can be further seen from the drawing, each outer lateral wall 4 is formed as a low guiding web on the bottom plate 3, which is raised only at its rear end portion **4*a* for forming an abutment surface located opposite to the pressing end of the legs 8*a* and 8*b* of the spring part. The course of the upper edge of the outer lateral walls 4** can be selected in the respective cases so as to provide for maximum economy of material with best possible functioning at the same time.

The front ends of the outer lateral walls 4 or their guiding webs which form the removing openings 6 are curved outwardly in a funnel-like manner, as identified with reference numeral 10. The upper edges of the lateral walls 4 or their guiding webs are rounded in this region so as to run toward the bottom plate. Advantageously, the upper edges of the lateral walls 4 and their guiding webs are rounded in inclined manner toward the compartments 1 and 2, respectively.

As can further be seen from the drawings, the bottom plate 3 in its region **3*a* of the withdrawing opening 6 is rounded so as to extend outwardly beyond the apex of the wedge-shaped wall portion 7. The front end or the apex of the wedge-shaped wall portion 7 is rearwardly offset relative to the front ends 10 of the outer lateral walls 4 or their guiding webs, so that the objects inserted in the front region above the region 3*a*** of the bottom plate can contact with their edges.

With, the above described arrangement and the above described curvature of the compartments, it is provided that the inserted sheet-like objects such as postcards and the like abut against the end portion **4*a* of the lateral walls 4, on the one hand, and against the apex of the wedge-shaped wall portions 7, on the other hand, so that a funnel-shaped opening is formed at the front curved ends 10** which facilitates insertion or repeated insertion of such sheet-like objects or record carriers.

The depth of the compartments 1 and 2 is limited in the embodiment of FIG. 1 only by a schematically shown end abutment 11 which can be seen in FIG. 1 in the front compartment 2. This end abutment 11 is held on the bottom plate 3 in a suitable manner displaceable and/or adjustable, for example by a pivot pin or by a connecting pin. Advantageously it is inclined toward the direction of elongation of the compartments 1 and 2, so that when a plurality of sheet-shaped objects are inserted into the compartment they are offset relative to one another in the longitudinal direction of the compartment in a so-called ragged arrangement.

In the embodiment of FIG. 1, one compartment, namely the compartment 2, of each pair of compartments 1, 2 is longer than the other compartment 1 by extension of the lateral wall so as to form an elongated compartment portion 12. After removal or turning of the end abutment 11, the respective compartment 2 can therefore receiver longer objects.

The article display stand shown in FIG. 2 has the compartment and the compartment pairs substantially corresponding to those of FIG. 1, and the same parts are identified with the same reference numerals.

The etagere shown in FIG. 2 has, however, in the region of the bottom plate which follows the rear end of the compartments 1 and 2 a supply compartment 14. The supply compartment 14 is formed by partitions 13 and used for insertable objects.

In the display stand in accordance with both embodiments of FIGS. 1 and 2, the common bottom plate 3 is formed star-like so as to follow the outer contour of the compartments 1 and 2, as can be seen from the drawing. The bottom plate 3 is provided between the compartment pairs with substantially V-shaped cut-outs with an apex directed toward the center of the etagere.

With the exception of the spring part 8, all structural parts of the etagere or the compartment pairs can be composed of a transparent synthetic plastic material. Particularly when the inventive article display stand is formed as an etagere and in connection with the selected structural shape, an essential economy of material can be obtained.

While the above presented description illustrates the structural shape of the compartment pairs, it is also possible by respective design of the rear part of the compartment pair in deviation from the above described shape of an etagere, to form a compartment pair or several compartment pairs console-like with flat rear surfaces to provide suitable flat walls or standing surfaces, or support with such console-like arrangement in accordance with the invention.

The above described embodiments and the latter described possible embodiments show that with the inventive V-shaped arrangement of the compartment pairs with complete presentation of the observation surface of the insertable objects an extraordinarily high reduction of the required rear mounting surfaces is obtained, or in other words, as compared with the flat face presentation, an essential increase of the observation surface is attained.

It will be understood that each of the elements described above, or two or more together, may also find a useful application in other types of constructions differing from the types described above.

While the invention has been illustrated and described as embodied in an article display stand, particularly for sheet-like data carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An article display stand, particularly for sheet-like data carriers, comprising a substantially horizontal bottom plate having an outer edge; and at least two pairs of substantially vertical lateral walls arranged on said bottom plate and forming at least two upwardly open elongated compartments for accomodating objects in an upright position, each of said compartments having an object withdrawing opening formed in the region of said outer edge of said bottom plate, said lateral walls of each of said compartments extending at a substantially uniform distance from one another, the lateral walls of one of said compartments approaching the lateral walls of the other of said compartments and therefore said compartments approaching one another in direction toward the respective withdrawing openings so that said compartments form an angle therebetween, and said withdrawing openings of said two compartments being located near one another.

2. An article display stand as defined in claim 1, wherein said two pairs of lateral walls include two inner lateral walls and two outer lateral walls, said inner lateral walls facing toward one another and having longitudinal portions located adjacent to said withdrawing openings and together forming a common one-piece wall portion.

3. An article display stand as defined in claim 2, wherein said one-piece wall portion is wedge-shaped and has an apex facing toward said withdrawing openings.

4. An article display stand as defined in claim 3, wherein said bottom plate in the region of said withdrawing openings is rounded beyond said apex of said wedge-shaped wall portion.

5. An article display stand as defined in claim 3, wherein said two pairs of lateral walls include two inner walls and two outer walls, said outer walls having front ends; said wedge-shaped wall portions having a front end which is rearwardly offset relative to said front ends of said outer lateral walls.

6. An article display stand as defined in claim 3, wherein said two pairs of lateral walls include two inner walls and two outer walls, said outer walls having front ends; said apex of said wedge-shaped wall portion being rearwardly offset relative to said front ends of said outer lateral walls.

7. An article display stand, particularly for sheet-like data carriers, comprising a substantially horizontal bottom plate having an outer edge; and at least two pairs of substantially vertical lateral walls arranged on said bottom plate and forming at least two upwardly open elongated compartments for accommodating objects in an upright position, each of said compartments having an object withdrawing opening formed in the region of said outer edge of said bottom plate, said lateral walls of each of said compartments approaching one another in direction toward the respective withdrawing openings so that each of said compartments forms an angle in direction of its elongation, and said withdrawing openings of said two compartments being located near one another, said two pairs of lateral walls including two inner lateral walls and two outer lateral walls, at least said outer lateral walls and thereby the course of said compartments being arcuately curved outwardly from one another starting from said withdrawing openings.

8. An article display stand, particularly for sheet-like data carriers, comprising a substantially horizontal bottom plate having an outer edge; at least two pairs of substantially vertical lateral walls arranged on said bottom plate and forming at least two upwardly open elongated compartments for accommodating objects in an upright position, each of said compartments having an object withdrawing opening formed in the region of said outer edge of said bottom plate, said lateral walls of each of said compartments approaching one another in direction toward the respective withdrawing openings so that each of said compartments forms an angle in direction of its elongation, and said withdrawing openings of said two compartments being located near one another, said two pairs of lateral walls including two inner walls and two outer walls, said outer walls having rear portions; and at least one flat spring element held on said inner lateral walls in each compartment so as to act upon an object accommodated therein, each of said flat spring elements having a free pressing end directed against said rear portion of the respective outer lateral wall.

9. An article display stand as defined in claim 8, wherein each of said flat spring elements is formed as a substantially V-shaped unitary spring part having two legs and an apex arranged so that said legs are deflectable independently of one another.

10. An article display stand as defined in claim 9, wherein said inner lateral walls have longitudinal portions adjacent to said withdrawing openings and united with one another so as to form together a one-piece wedge-shaped wall portion having a rear end, said apex of said V-shaped spring part being held on said rear end of said wedge-shaped wall portion.

11. An article display stand as defined in claim 10, wherein said rear end of said wedge-shaped wall portion is provided with a pin, said apex of said spring part being provided with a mouth-shaped formation which is held on said pin in a self-clamping manner.

12. An article display stand as defined in claim 11, wherein said bottom plate, said lateral walls, said wedge-shaped wall portion with said pins are composed of a transparent synthetic plastic.

13. The article display stand as defined in claim 9, wherein said legs and said pressing end are arcuately curved so that with a completely filled compartment only said pressing end pressingly abuts against an inserted object.

14. An article display stand as defined in claim 9, wherein each of said spring parts has a pressing end, each of said outer lateral walls being formed as a relatively low guiding web arranged on said bottom plate and having a raised rear end portion which forms an abutment surface for said pressing end of said spring part.

15. An article display stand, particularly for sheet-like data carriers, comprising a substantially horizontal bottom plate having an outer edge; and at least two pairs of substantially vertical lateral walls arranged on said bottom plate and forming at least two upwardly open elongated compartments for accommodating objects in an upright position, each of said compartments having an object withdrawing opening formed in the region of said outer edge of said bottom plate, said lateral walls of each of said compartments approaching one another in direction toward the respective withdrawing openings so that each of said compartments forms an angle in direction of its elongation, and said withdrawing openings of said two compartments being located near one another, said two pairs of lateral walls including two inner walls and two outer walls, said outer lateral walls having front ends which form said withdrawing openings and are curved outwardly from one another in a funnel-like manner.

16. An article display stand, particularly for sheet-like data carriers, comprising a substantially horizontal bottom plate having an outer edge; and at least two pairs of substantially vertical lateral walls arranged on said bottom plate and forming at least two upwardly open elongated compartments for accommodating objects in an upright position, each of said compartments having an object withdrawing opening formed in the region of said outer edge of said bottom plate, said lateral walls of each of said compartments approaching one another in direction toward the respective withdrawing openings so that each of said compartments forms an angle in direction of its elongation, and said withdrawing openings of said two compartments being located near one another, said two pairs of lateral walls including two inner walls and two outer walls, said outer lateral walls having upper edges which are rounded and inclined toward said withdrawing openings.

17. An article display stand, particularly for sheet-like data carriers, comprising a substantially horizontal bottom plate having an outer edge; at least two pairs of substantially vertical lateral walls arranged on said bottom plate and forming at least two upwardly open elongated compartments for accommodating objects in an upright position, each of said compartments having an object withdrawing opening formed in the region of said outer edge of said bottom plate, lateral walls of each of said compartments approaching one another in direction toward the respective withdrawing openings so that each of said compartments forms an angle in direction of its elongation, and said withdrawing openings of said two compartments being located near one another; and means for limiting the depth of said compartments and including an end abutment provided in each of said compartments.

18. An article display stand as defined in claim 17, wherein said end abutment of each of said compartments is adjustable.

19. An article display stand as defined in claim 17, wherein said compartments each extend in a predetermined direction of elongation, each of said end abutments being inclined relative to the direction of elongation of the respective compartment so that when a plurality of sheet-shaped objects are accommodated in the respective compartment they are offset relative to one another in a stepped manner in the direction of elongation of the respective compartments.

20. An article display stand, particularly for sheet-like data carriers, comprising a substantially horizontal bottom plate having an outer edge; a plurality of pairs of substantially vertical lateral walls arranged on said bottom plate and said pairs forming at least two upwardly open elongated compartments for accommodating objects in an upright position, said pairs of compartments being arranged in a star-like manner relative to one another, each of said compartments having an object withdrawing opening formed in the region of said outer edge of said bottom plate, said lateral walls of each of said compartments of each of said pairs approaching one another in direction toward the respective withdrawing openings so that each of said compartments of each of said pairs forms an angle in direction of its elongation, and said withdrawing openings of said two compartments of each of said pairs being located near one another.

21. An article display stand as defined in claim 20, wherein said pairs of compartments have a star-like outer contour, said bottom plate having a star-like contour following said star-like outer contour of said pairs of compartments.

22. An article display stand as defined in claim 20, wherein one of said compartments is formed longer than the other of said compartments of said one pair of compartments.

23. An article display stand as defined in claim 22, wherein some of said lateral walls are formed longer than other of said lateral walls so as to form said one longer compartment.

24. An article display stand as defined in claim 22, wherein said compartments have rear ends, said bottom plate having a region following said rear end of said compartment; and further comprising a plurality of partitions to form a supply compartment for insertable objects in said region of said bottom plate.

25. An article display stand as defined in claim 12, wherein said bottom plate, said lateral walls, and said partitions are made of a transparent synthetic plastic material.

* * * * *